US006151935A

United States Patent [19]

Evans et al.

[11] Patent Number: 6,151,935

[45] Date of Patent: Nov. 28, 2000

[54] DEADBOLT COMBINATION LOCK SYSTEM WITH AUTOMATIC LOCKING SPRING BOLT

[75] Inventors: Walter R. Evans; James D. Hamilton; Kenneth H. Mimlitch, all of Lexington, Ky.

[73] Assignee: MAS-Hamilton Group, Lexington, Ky.

[21] Appl. No.: 08/924,948

[22] Filed: Sep. 8, 1997

[51] Int. Cl.[7] ..... E05B 37/08

[52] U.S. Cl. ..... 70/303 A; 70/143; 70/303 R; 70/486; 70/DIG. 6; 292/169.44; 292/332; 292/333; 292/335; 292/DIG. 44

[58] Field of Search ..... 292/169.14, 332, 292/333, 335, DIG. 44, 169.13; 70/143, 303 R, 303 A, 486, DIG. 6

[56] References Cited

U.S. PATENT DOCUMENTS

| | | | |
|---|---|---|---|
| Re. 21,608 | 10/1940 | Brinton . | |
| 427,157 | 5/1890 | Cook | 292/335 |
| 1,625,595 | 4/1927 | Eastlack | 292/333 |
| 2,015,248 | 9/1935 | Williams . | |
| 2,609,224 | 9/1952 | Mitchell . | |
| 2,723,873 | 11/1955 | Schlage . | |
| 3,073,143 | 1/1963 | Eads . | |
| 3,242,706 | 3/1966 | Check . | |
| 3,257,135 | 6/1966 | Russell et al. . | |
| 3,353,858 | 11/1967 | Neary et al. | 292/169.14 X |
| 3,554,593 | 1/1971 | Hawkins . | |
| 3,605,459 | 9/1971 | Van Dalen . | |
| 3,794,366 | 2/1974 | Graham | 292/169.14 X |
| 4,328,689 | 5/1982 | Keller et al. | 70/303 A |
| 4,711,477 | 12/1987 | Fann et al. | 292/169.14 |
| 4,739,638 | 4/1988 | Lin | 292/335 X |
| 4,848,118 | 7/1989 | Tesone | 70/419 |
| 5,257,519 | 11/1993 | Miller, III | 70/303 A |
| 5,511,401 | 4/1996 | Brooks et al. | 70/303 A |
| 5,609,371 | 3/1997 | Madev et al. | 292/164 |
| 5,615,919 | 4/1997 | Ivey | 292/332 |

FOREIGN PATENT DOCUMENTS

| | | | |
|---|---|---|---|
| 618958 | 3/1949 | United Kingdom | 292/335 |
| 2039983 | 8/1980 | United Kingdom . | |

*Primary Examiner*—Lloyd A. Gall
*Attorney, Agent, or Firm*—Arent Fox Kintner Plotkin & Kahn; Rustan J. Hill; Laurence R. Letson

[57] ABSTRACT

A deadbolt lock and a deadbolt which will extend automatically whenever a container is locked by virtue of a rigid portion of the container engaging a trigger element extending from the end face of the bolt and causing the release of an outer bolt portion is shown and described herein. The release of the outer bolt of the bolt assembly allows the outer bolt to project outwardly and to lock the container notwithstanding the fact that the bolt has not been reset by the operator of the lock. The bolt is self-contained and can be substituted into many existing lock mechanisms of the mechanical type and into some of the existing electronic dial combination locks, to provide the auto-locking enhancement.

22 Claims, 10 Drawing Sheets

DEADBOLT COMBINATION LOCK SYSTEM WITH AUTOMATIC LOCKING SPRING BOLT

FIELD OF THE INVENTION

This invention relates to deadbolt locks and more specifically to deadbolt locks that lock automatically whenever a closure door is closed or a bolt-work displaced to align a bolt recess with the lock bolt.

BACKGROUND OF THE INVENTION

A deadbolt lock is equipped, in most cases, with a rectangular solid bolt. The bolt of a deadbolt lock is not extendible to lock until aligned with a bolt recess, i.e., behind a jamb, a notch in a bolt-work, or an opening in a strike or other similar unobstructed volume of space into which the bolt may extend.

In order to close a security container and lock a dial combination lock, such as a Mas-Hamilton X-07 or a Mas-Hamilton Auditcon series combination lock to secure the container, it is necessary to first close the container upon which the lock is mounted, and thereafter to extend the bolt by manually rotating a dial knob or control while the bolt is aligned with a recess or void space, thereby permitting its extension. Due to the rectangular solid structure of the bolt, the container cannot be closed with the bolt extended; and if not extended after closing, the container remains insecure. The Mas-Hamilton X-07 and Auditcon locks are available from the Mas-Hamilton Group, Lexington, Ky.

In environments where there is required frequent access to the container such as a safe, for instance, in retail stores, fast food restaurants, and businesses with a high-volume of cash business employees tend to leave the lock unlocked between accesses in order to reduce or eliminate the nuisance of opening the lock or having to locate a person with the lock combination for each opening or access. The door to the safe may be closed, but the lock is not relocked in such a manner that the safe is secure. This leaves the contents of the container available for pilferage or theft. There are many other environments where it is desirable to automatically lock the container upon closing while having the advantage of the bolt configured as a deadbolt.

An auto-locking device, capable of use in conjunction with a dial combination lock to automatically lock upon the door carrying the lock closing and engaging a strike, is variously marketed under the designation of LM5100 by Lockmasters of Nicholasville, Ky.; the Model 8475 marketed by Sargent and Greenleaf of Nicholasville, Ky.; and the CDX-07 electronic combination lock marketed by the Mas-Hamilton Group of Lexington, Ky. An example of the mechanism of the LM5100 is illustrated in U.S. Pat. No. 5,257,519. The mechanisms of the Sargent and Greenleaf 8475 and the Mas-Hamilton Group CDX-07 lock also incorporate a spring-biased bolt and a triggering device outside the spring-biased bolt to release the spring-biased bolt.

Disadvantages of the LM5100 and both the other automatic locking devices identified above are that use of such a device requires an installation of the device and the lock on the interior of the container door such that these devices do not lend themselves to merely replacing the combination lock previously installed. The need for new holes to be drilled in the container door leaves the previous holes as a possible source of vulnerability to the container, and these devices require a second locking device with a combination lock in order to accomplish the desired function. The Lockmasters LM5100, Sargent & Greenleaf Model 8475 and the Mas-Hamilton CDX-07 locks all require the lock bolt to be extended in order for the lock to lock the door, thereby blocking the spring-biased bolt to ensure that the container is locked and secure; otherwise, the spring-biased bolts may be subject to being dislocated and the container or room opened. The extending of the lock bolt requires the rotation of the lock knob or dial.

OBJECTS OF THE INVENTION

It is an object of the invention to dead bolt lock a container whenever the closure or door is closed and the bolt lock passes the jamb or a strike, without the requirement to place the lock in a locked mode.

It is another object of the invention to incorporate the locking and closing function into a deadbolt lock in a manner permitting the retrofitting of conventional key and deadbolt dial combination locks with the feature and with a minimum of parts being required to be changed.

It is an additional object of the invention to provide an auto-locking function contained within a deadbolt of a dial combination lock.

It is a further object of the invention to effect the locking of a container whenever a bolt-work is removed from the interfering position with the bolt and that permits the bolt to automatically extend to lock the bolt-work and thus lock the container, when the bolt work is returned to its non-interfering position.

SUMMARY OF THE INVENTION

The problems, deficiencies and shortcomings posed by the prior lock mechanisms are overcome while at the same time accomplish the objects of the invention by the invention summarized below.

The solid conventional dead bolt of a lock is replaced by a bolt assembly which is capable of extension upon triggering resulting from engagement with an interfering structure of the security container. Engagement of the bolt assembly with an interfering member or structure displaces a trigger element which in turn acts to disengage a latch, permitting one portion of the spring bolt assembly to displace or move away from the other portion of a two-portion spring bolt assembly. The two portions of the bolt are spring-biased to extend and displace away from the other whenever unlatched. The trigger mechanism extends from the end face of the outer bolt. The inner bolt is attached to and responsive to the bolt lever of the lock for extension and withdrawal.

Whenever the container is locked, the outer bolt is extended. The inner bolt may be in an extended or withdrawn position, but must be moved to the extended position prior to unlocking the container by withdrawing the bolt in order to latch the outer bolt and then to withdraw the outer bolt.

The extension of the inner bolt compresses the spring which tends to separate the bolt parts and latches the outer bolt to the inner bolt. The latching action of the latch causes the trigger to extend from the end face of the outer bolt to a position where it is engageable by the container member, whereupon closure of the container door or bolt-work triggers the latch and releases the outer bolt for extension. The latched spring bolt assembly is conditioned at this point to be withdrawn and the container unlocked.

Anytime the lock is operated and the bolt withdrawn, the container is insecure and unlocked. If the container is the type having a bolt-work which is blocked by the bolt of the lock, the bolt must be moved or withdrawn in order to shift the bolt-work to open the container; and the movement of the bolt-work, after the lock bolt has been withdrawn, will engage the bolt-work with the trigger and force it into the outer bolt, thereby unlatching the latch holding the inner and outer bolt members together. Subsequent movement of the bolt-work to a container locking position will align the bolt recess in the bolt work with the bolt and the outer bolt member will extend under the influence of a spring force to lock the bolt-work and thus lock the safe or the container. The inner bolt can reside in and can remain in the withdrawn position with the container remaining secure.

When the outer bolt extends, the outer bolt aligns a countersunk hole with a hole in the lock casing containing a spring-biased ball detent. As the two holes align, the ball is forced into the bolt to an extent that the ball center is within the volume of the outer bolt, dead locking the outer bolt against retraction. Thus the lock is locked even without the inner bolt being extended.

In a second embodiment, the trigger of the outer bolt is configured to be engaged by a strike as the door of a safe or container is swung closed. The same actions of and within the bolt occur. The swinging door installation requires a movable strike to permit passage of the bolt and the trigger upon opening the safe as well as blocking the path of the trigger whenever the bolt is passed by the strike upon closing to unlatch the inner and outer bolt members.

A more complete and better understanding of the invention may be had from the attached drawings and the detailed description of the invention to follow.

DETAILED DESCRIPTION OF THE INVENTION

Because the lock 10 as illustrated and described is or can be a conventional lock and only serves as a host for the spring bolt, only a portion of the lock 10 is illustrated and described.

Figure 1:
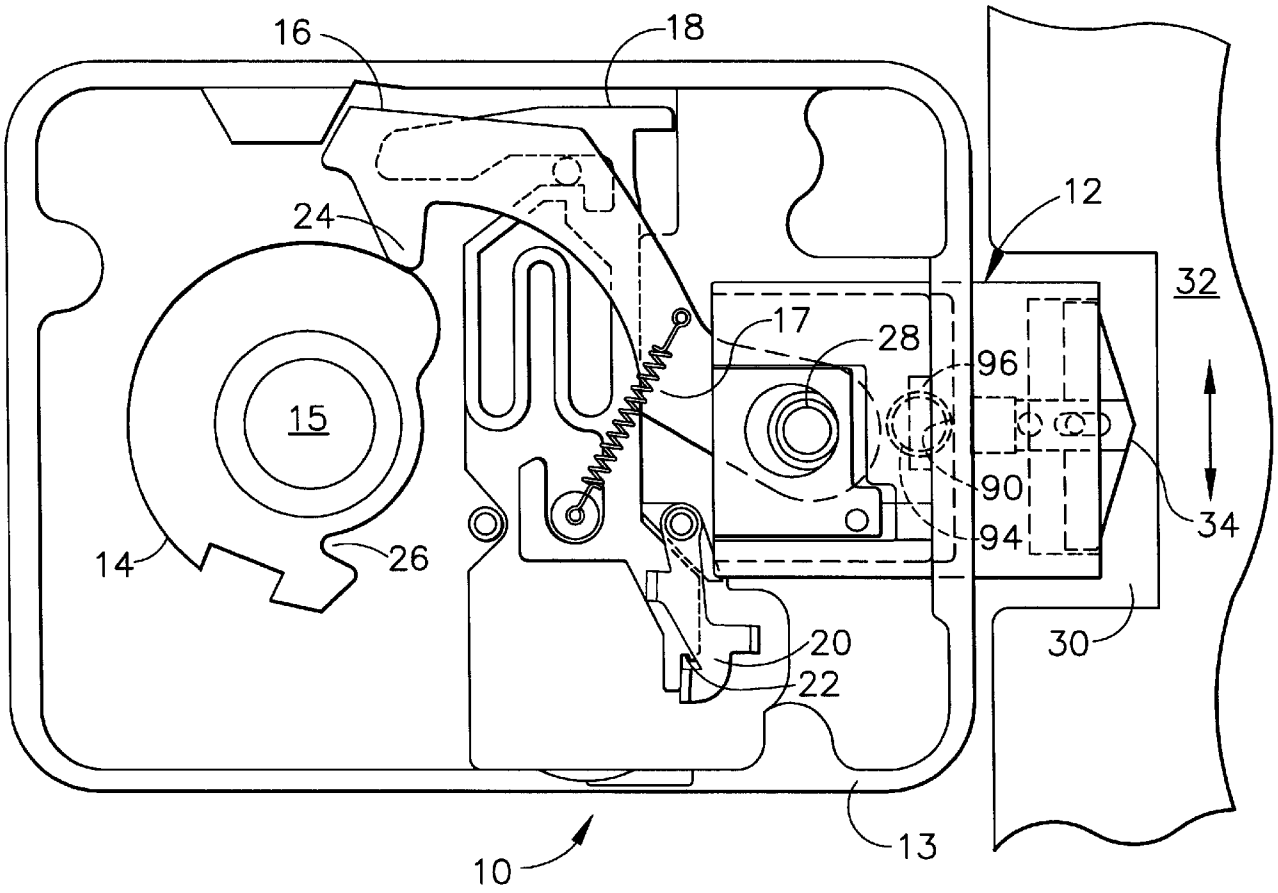
FIG. 1 illustrates a partial combination lock with the bolt embodying the invention and whereby the spring bolt assembly is in an extended and locked condition and the lock is fully locked.

Referring initially to FIG. 1, there is illustrated a partial dial combination lock 10, in this particular instance, an electronic combination lock. Only the parts of the dial combination lock necessary to understand the invention are illustrated. It should be understood that the spring bolt assembly 12 of this invention may be used both in manual dial combination locks and some key locks as well as some electronic locks. Lock 10 has a dial cam 14 which is rotatable by a shaft 15, which is manually bi-directionally manipulatable. Spring bolt assembly 12 extends from the lock casing 13 into a bolt-work bolt recess 30 of bolt-work 32.

Spring bolt assembly 12 is capable of being withdrawn by a lateral right-to-left movement of bolt lever 16 and bolt lever screw 28, which connects bolt lever 16 with the spring bolt assembly 12. Bolt lever 16 is pivotable in a counter-clockwise direction about bolt lever screw 28 by movement of slide 18 in a downward direction in response to the entry of an authorized combination or key and electrical energy being provided to a solenoid, electrical motor or electrical drive device (not shown) which, upon energization, will displace blocking element or latch 20 in a counter-clockwise direction disengaging blocking element or latch 20 from the notch 22 in the lower extremity of slide 18. Slide 18 thereafter may be translated downward by a spring-bias on bolt lever 16 exerted by a spring 17. Nose portion 24 of bolt lever 16 may be pulled downwardly into gate 26 formed by the contours of cam 14. The rotation of cam 14 in a counterclockwise direction will engage the gate 26 with the nose portion 24 for the purpose of pulling bolt lever 16 in a right-to-left direction. Movement of bolt lever 16 and bolt lever screw 28 in a right-to-left direction will necessarily displace bolt lever screw 28 in a leftward direction and withdraw the spring bolt assembly 12 into the lock housing 13.

Figure 2:
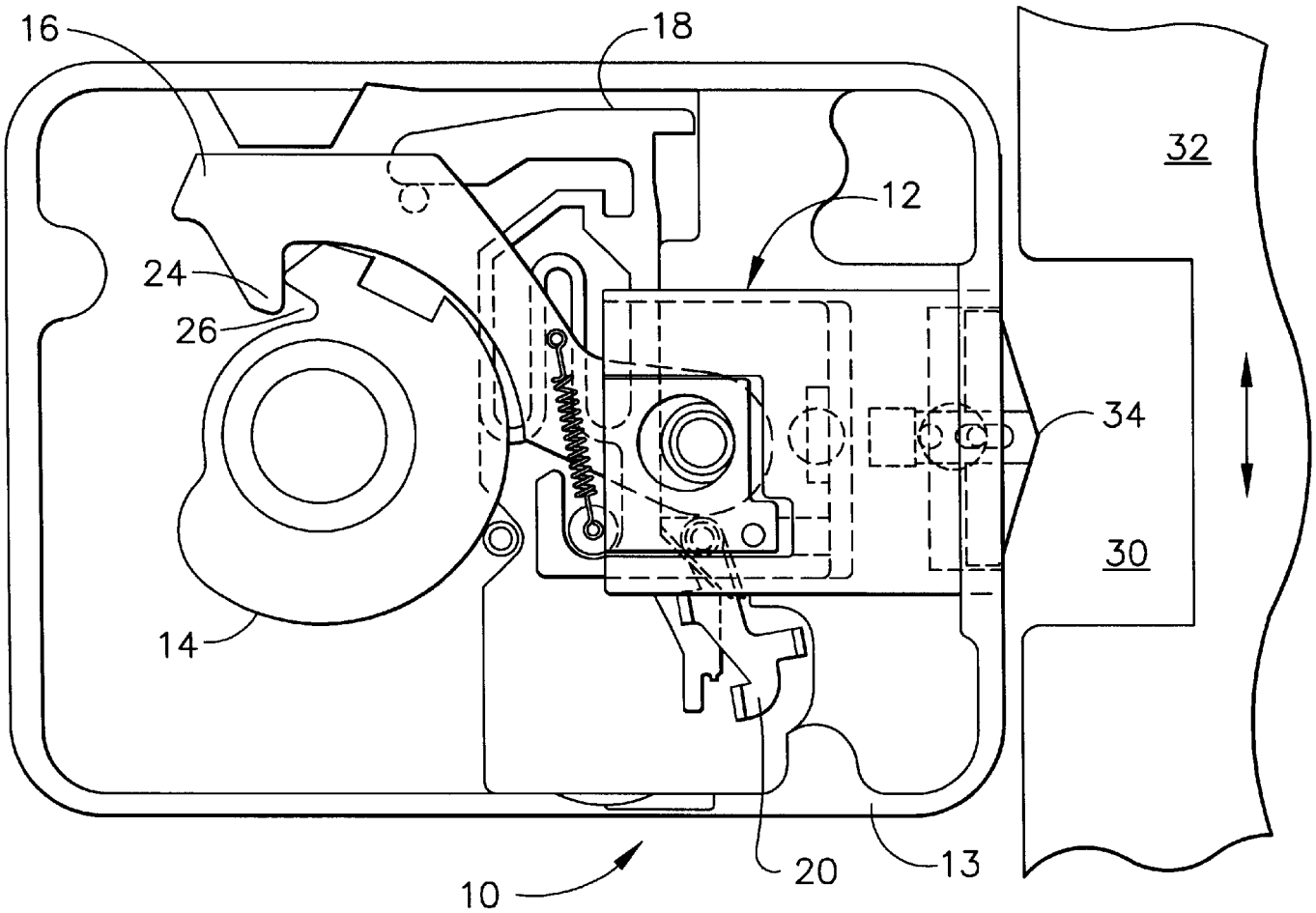
FIG. 2 illustrates the partial combination lock of FIG. 1 with the spring bolt assembly fully withdrawn.

The condition described immediately above is best viewed in FIG. 2 where the spring bolt assembly 12 has been withdrawn to be within lock housing 13. As can be seen, dial cam 14 is engaged with and has pulled bolt lever 16 to a retracted position.

With spring bolt assembly 12 withdrawn within the lock housing 13, as illustrated in FIG. 2, the bolt-work 32 is freed to be displaced in a generally vertical direction as indicated by the double-headed arrow thereon, and thereby bolt work 32 permits the withdrawal of conventional locking bolts extending from the safe door (not shown) into the safe door jamb (not shown).

Figure 3:
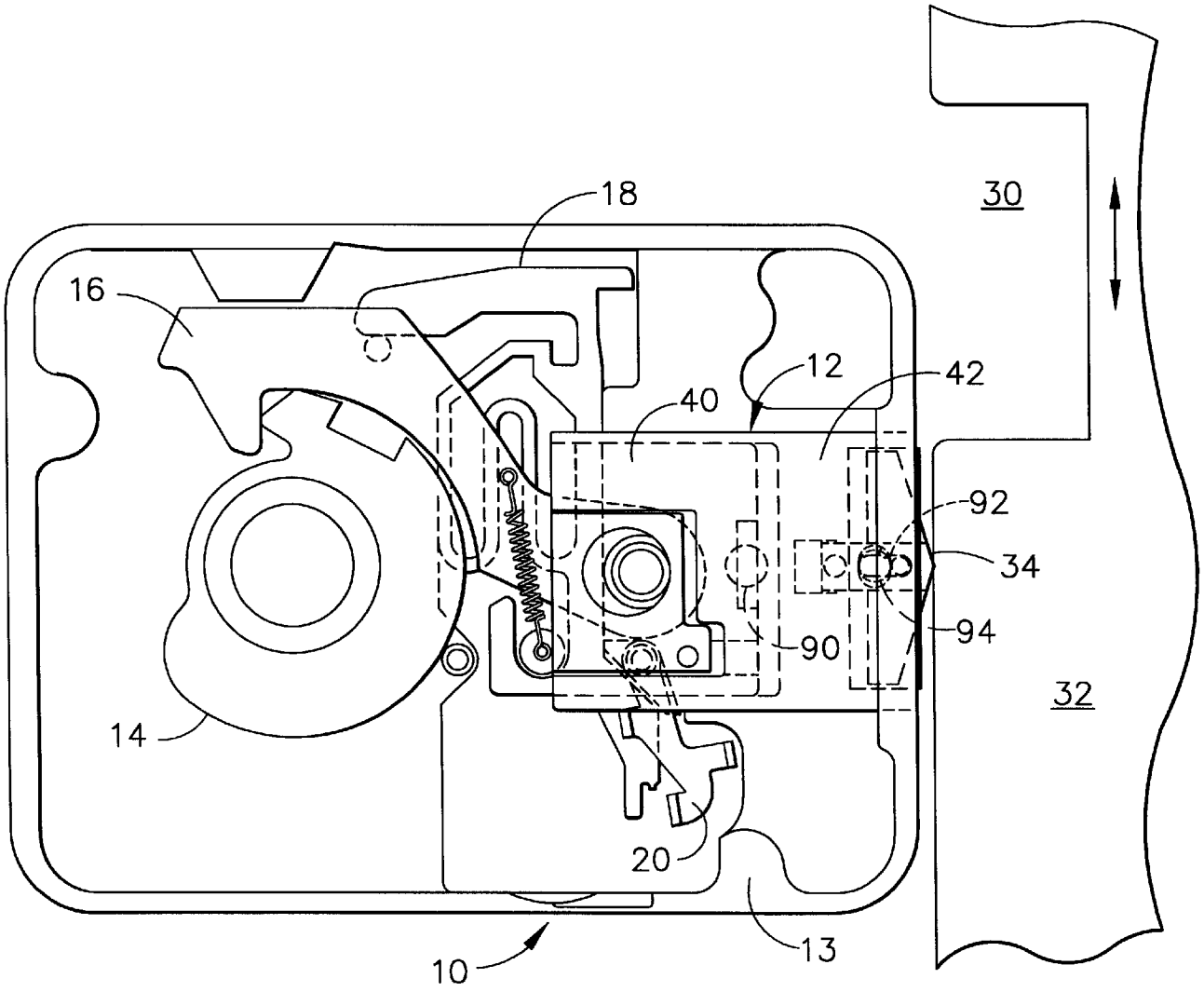
FIG. 3 illustrates the partial combination lock of FIG. 1 with the spring bolt assembly withdrawn and the trigger depressed by the bolt-work.

Translation of the bolt-work 32 from the position illustrated in FIG. 2 to the position in FIG. 3, which will permit the opening of the safe or container, causes the trigger 34 to be engaged by the bolt-work 32 as shown in FIG. 3 and to be forced leftward into the spring bolt assembly 12. Forcing of the trigger 34 leftward into the spring bolt assembly 12 will release a latch which holds the inner bolt 40 and the outer bolt 42 of the spring bolt assembly 12 in a latched, retracted position, thereby permitting the outer bolt 42 to be partially restored to an extended position and fully restored as the bolt-work 32 is removed from engagement with the trigger 34. Description of the latch will be made with reference to latch 62 of FIGS. 5, 6, and 7, below.

Referring now to FIG. 4, the bolt-work 32 again has been moved from its previous position, in the plane of the drawing, to present the bolt recess 30 to the spring bolt assembly 12, thereby permitting the extension of the outer bolt 42 to a position which effectively blocks unlocking movement of the bolt-work 32. Inner bolt 40 remains in a withdrawn position as does the bolt lever 16 and dial cam 14. Notwithstanding the fact that the cam 14 and bolt lever 16 remain in what would be considered a withdrawn position or unlocked position, the extension of the outer bolt 42 into the bolt recess 30 of bolt-work 32 does not effect the security of the container because the outer bolt 42 is in its fully extended position to block the movement of bolt-work 32 and thus prevents the opening of the container.

When the outer bolt 42 is extended upon movement of the bolt-work 32 to its locked position, countersunk hole 90, FIG. 1, formed into outer bolt 42 will move into alignment with hole 92 in lock case 13. The countersunk hole 90 is deep enough to partially accommodate a steel ball 94 resident in and biased out of hole 92. The ball 94 is sized in relation to countersunk hole 90 to place the center of the ball 94 within the body of outer bolt 42. Any attempt to force the outer bolt 42 back into the lock case 13 will bind the ball 94, preventing movement of the outer bolt 42. Thus the outer bolt 42 is prevented from being dislocated under the influence of end bolt pressure.

Figure 5:
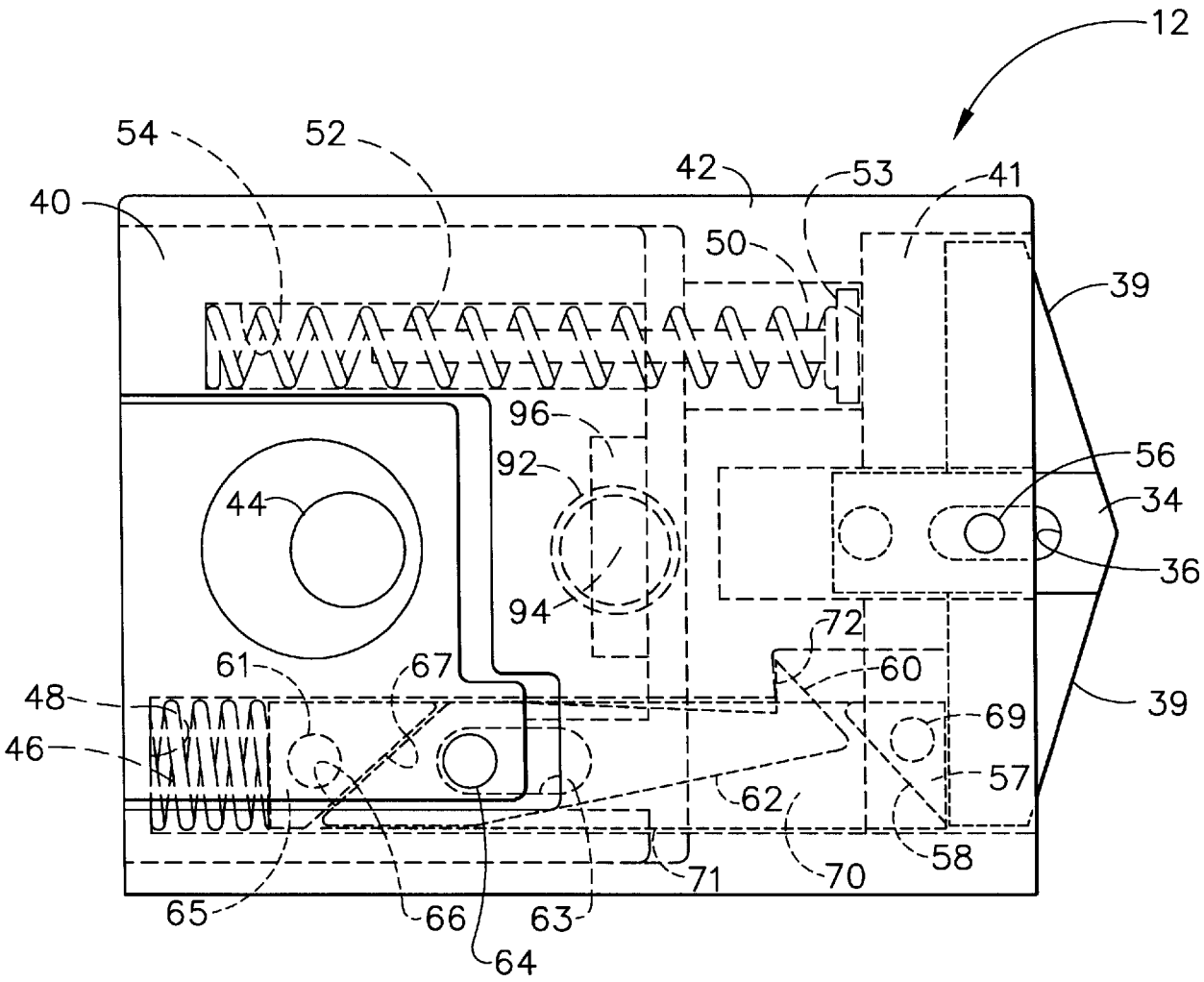
FIG. 5 is an illustration of the spring bolt assembly in detail and in the latched condition, as in FIG. 1.

Referring now to FIGS. 5 and 1, the inner bolt 40 of spring bolt assembly 12 is further provided with a sloping camming surface 96. As may be observed in FIG. 5, camming surface 96 is disposed over countersunk hole 90 when the inner bolt 40 and outer bolt 42 are latched as when the inner bolt 40 is extended as shown in FIG. 1. The camming surface, as it is moved into alignment with countersunk hole 90 will cam or force ball 94 partially out of the countersunk hole 90 and back into hole 92 sufficiently that the ball center is again disposed outside the confines of outer bolt 42. Accordingly, the ball 94 may be forced completely out of the outer bolt and into hole 92, releasing outer bolt 42 from deadbolting and rendering outer bolt 42 capable of withdrawal by withdrawal of the inner bolt 40.

Figure 4:
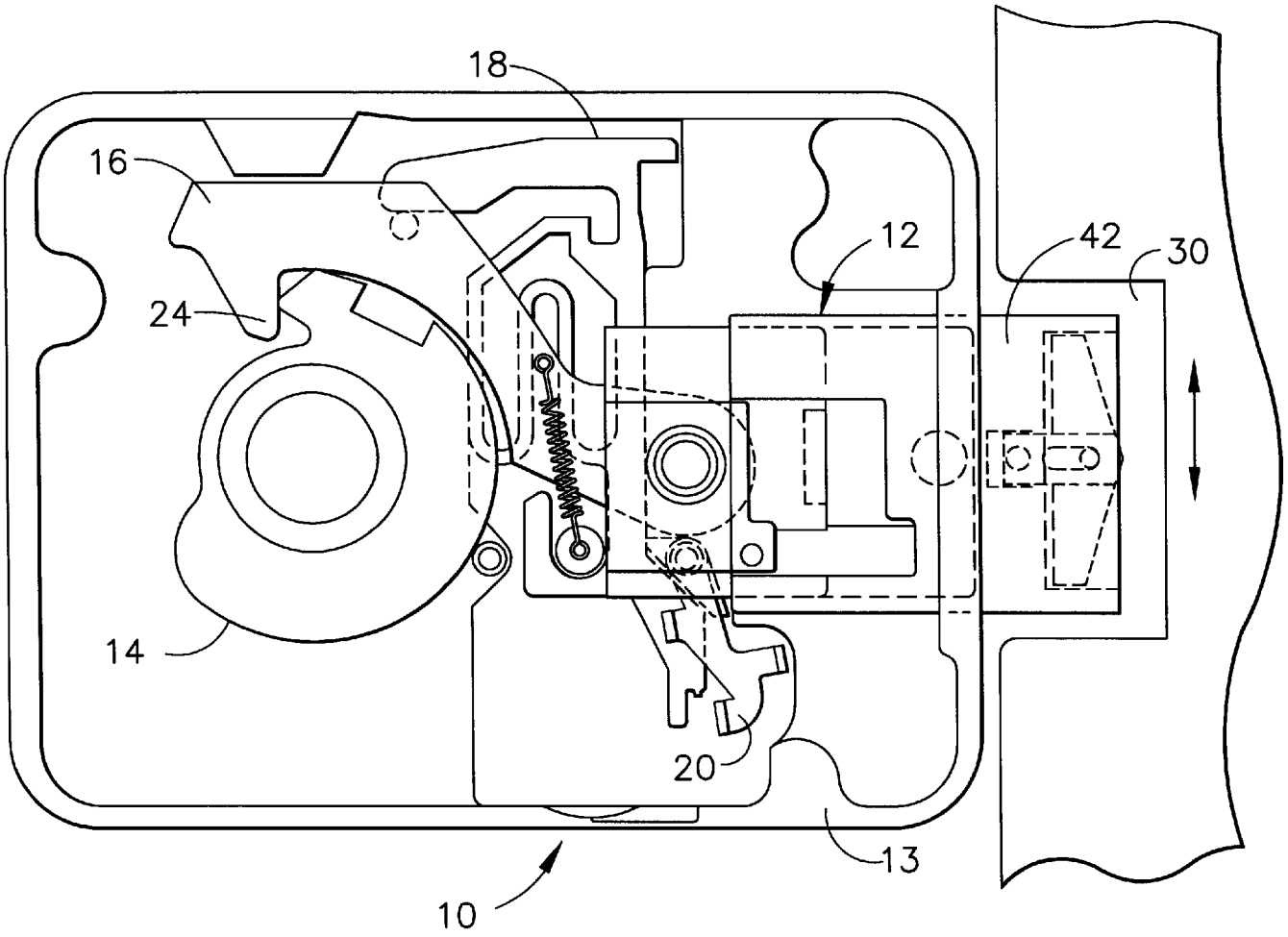
FIG. 4 illustrates the partial combination lock of FIG. 1 with the spring bolt assembly in a separated and locking condition while the lock and inner bolt remain in a withdrawn condition.

In order to be able to operate the lock 10 to cause the lock 10 to be unlocked and the container to be openable, the dial cam 14 must be rotated in a clockwise direction as shown in FIGS. 1–4. With reference to FIG. 4, with the lock 10 dead locked, the only direction that the dial cam 14 can rotate is clockwise inasmuch as the inner bolt 40 has been withdrawn to the limit of its travel, bolt lever 16 has been withdrawn and cannot translate further due to the lack of further clearance for the inner bolt 40, and thus the nose portion 24 of bolt lever 16 blocks further rotation of dial cam 14 in a counterclockwise direction. Accordingly, in order to operate the lock, the only direction that the dial cam 14 can be rotated is clockwise. Rotation of the cam 14 in a clockwise direction will act to restore the bolt lever 16 and to extend the inner bolt 40. Extension of the inner bolt 40 will result in the relatching of inner bolt 40 to outer bolt 42 into a latched, synchronized, moveable spring bolt assembly 12 and the repositioning of the ball 94 to disable the deadbolting function of the ball 94. Upon full restoration of the bolt lever 16 and the full extension of inner bolt 40, the lock 10 will have the configuration as illustrated in FIG. 1. Only thereafter may the lock 10 be operated to withdraw the spring bolt assembly 12. Accordingly, when an individual closes the container, the lock 10 locks itself and the container automatically.

Figure 6:
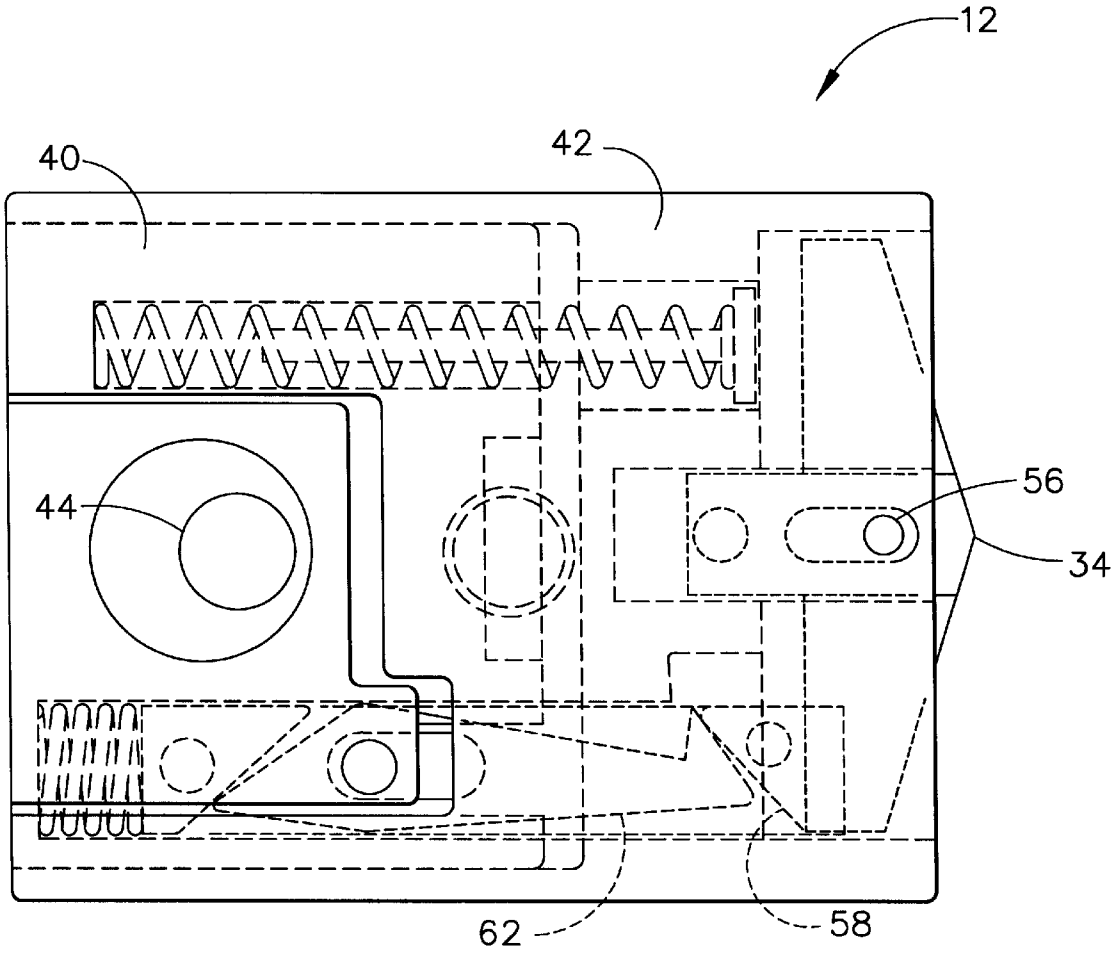
FIG. 6 is an illustration of the spring bolt assembly in the triggered and unlatched condition, as in FIG. 3.
Figure 7:
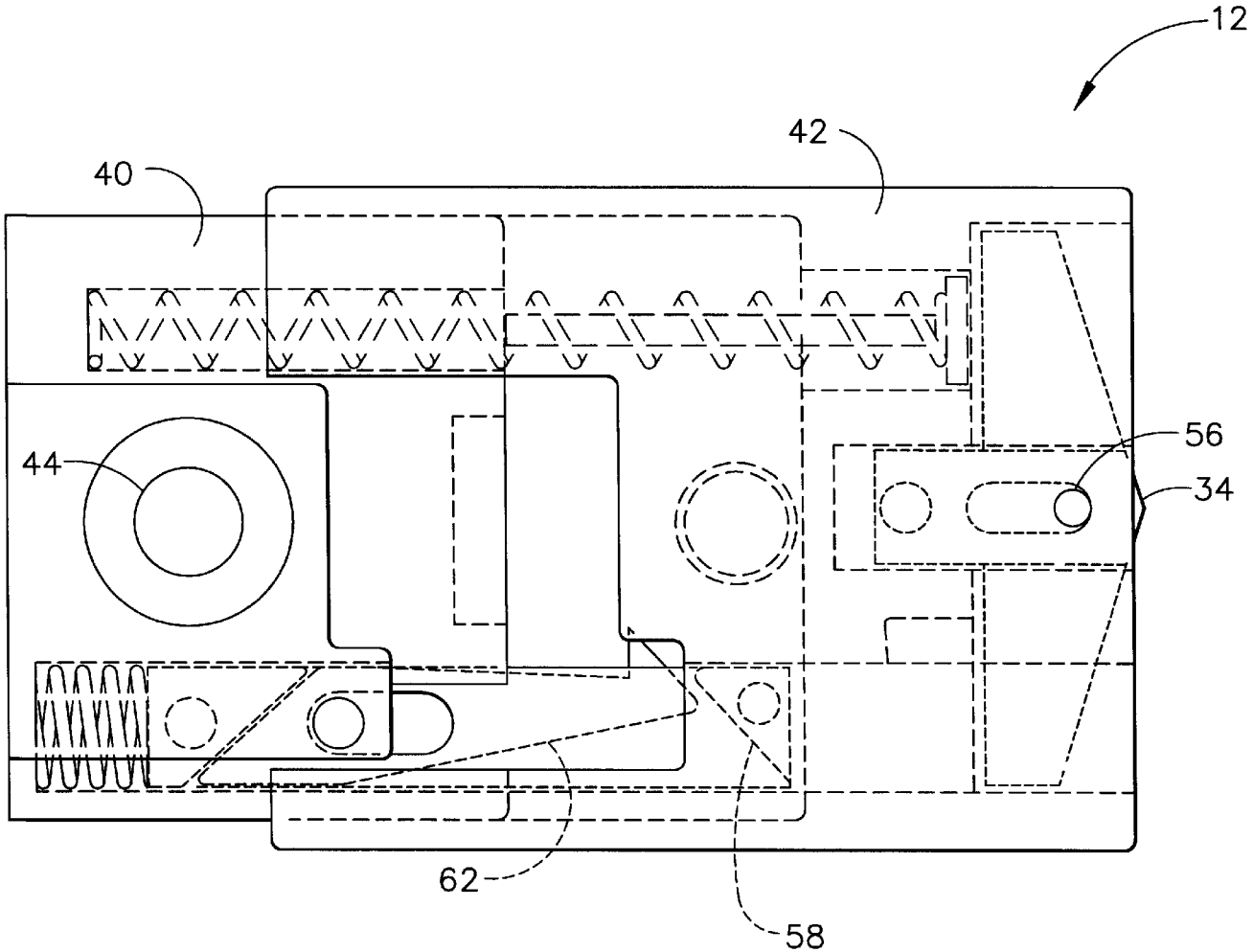
FIG. 7 is a detailed illustration of the bolt in an extended and unlatched condition, the condition illustrated in FIG. 4.

For a more complete understanding of the inner workings of the spring bolt assembly 12, reference is now made to FIGS. 5, 6 and 7. As described earlier, the spring bolt assembly 12 has an inner bolt 40 and an outer bolt 42. Inner bolt 40 is nested with outer bolt 42 to form an assembly whereby the two bolt portions 40, 42 are displaceable, one with respect to the other.

Inner bolt 40 is provided with a hole 44 for attaching the bolt lever 16 as shown in FIGS. 1–4. A blind hole recess 48 is formed into inner bolt 42 and accepts compression coil spring 46. Compression coil spring 46 acts against the latch assembly 71 which in one embodiment is in the form of a rod-like or cylindrical structure and is assembled from two partially cylindrical members 70 and two camming spacer elements 57 and 65. The camming spacer elements 65 and 57 are disposed between the two partially cylindrical members 70 such that together they form a cylinder. In the slot formed in the middle of the latch assembly 71 created by the spacer elements 57 and 65 holding the partially cylindrical members 70 spaced apart, a latch member 62 is disposed. The generally cylindrical cross-sectioned latch assembly 71, comprising members 70 and spacer elements 57 and 65, is held in its assembled condition by pins 61 and 69. Latch assembly 71 is provided with a slot 63 through which a pin 64 is extended to retain the latch member 62 within the assembly 71 and at the same time to permit some relative motion between the assembly 71 and latch 62 in a longitudinal direction. Pin 64 fixes latch member 62 with respect to any movement other than pivotal movement relative to the inner bolt 40. An alternate embodiment of the latch assembly 71 may be two partially cylindrical members 70 with the camming surfaces 58, 67 formed into the partially cylindrical members 70, thereby eliminating the need for separate spacer elements 57, 65.

The camming surface 67 on spacer 65 is oriented and configured to engage camming surface 66 on latch 62. Further, camming surface 60 on the opposite end of latch 62 is configured to be engaged by camming surface 58 of spacer element 57.

Inner bolt 40 further is provided with a blind hole recess 54 which will accept and accommodate a coil spring 52 and a spring guide 50. Spring guide 50 is configured to engage surface 53 within outer bolt 42 to urge the inner bolt 40 and outer bolt 42 to separate. Spring guide 50, in addition to providing an abutting surface for coil spring 52, also prevents the spring 52 from buckling and eliminates the possibility of binding between the spring 52 and either the inner bolt 40 or outer bolt 42.

Trigger 34 is disposed within a slot 41 in the outer bolt 42 and is capable of translation into and out of outer bolt 42 to the extent permitted by retaining pin 56 and slot 36. Slot 36 in trigger 34 permits relative movement between trigger 34 and pin 56.

The spring bolt assembly 12 illustrated in FIG. 5 is in its latched condition. In the latched condition, the trigger 34 has been extended from the outer bolt 42 by action of compression spring 46 and latch assembly 71 against trigger 34. When trigger 34 engages a solid resistance member against one of the camming slopes 39 on trigger 34 the camming action will cause the trigger 34 to be forced right to left into the outer bolt 42. Such movement will force the latch assembly 71 into inner bolt 40 and compress spring 46. Once this movement occurs, the slot 63 permits movement of the assembly 71 relative to pin 64 while latch 62 remains engaged with latching surface 72 on the outer bolt 42. Camming surface 58 will be translated to engage latch camming surface 60 and will pivot latch 62 to disengage latch surface 72 of outer bolt 42, thus releasing outer bolt 42 to extend and displace relative to inner bolt 40.

Restoration of the spring bolt assembly 12 to a latched condition occurs whenever the bolt lever 16, as illustrated in FIG. 4 and acting on inner bolt 40, translates inner bolt 40 rightward relative to outer bolt 42. In FIG. 5, as the displacement of inner bolt 40 occurs, coil spring 52 compresses and the latch assembly 71 is translated rightwardly until such time as latch 62 slips into engagement with latch surface 72. The movement of latch 62 pivotally about pin 64 is effected by the interaction between cam surface 66 on latch 62 and the cam surface 67 on spacer element 65. The two camming surfaces 66 and 67 are oriented to be parallel with each other any time latch 62 occupies its latched position engaged with latch surface 72.

Thus the spring bolt assembly 12 may be latched prior to withdrawal by merely extending the inner bolt 40 and forcing it against the spring forces exerted by coil spring 52 until such time as latch 62 is cammed onto and engages latch surface 72 of outer bolt 42. Thereafter, with any movement of the inner bolt 40 in a right-to-left direction as in FIG. 5, i.e., the withdrawal direction, under the influence of bolt lever 16 will similarly retract and withdraw outer bolt 42. After movement of the bolt-work 32, as seen in FIGS. 1–4 to engage the trigger 34, depression of trigger 34 will cause release of the latch 62 and permit the outer bolt 42 to be spring-biased into position to block the bolt-work 32 upon the bolt-work being restored to its locked position.

Figure 8:
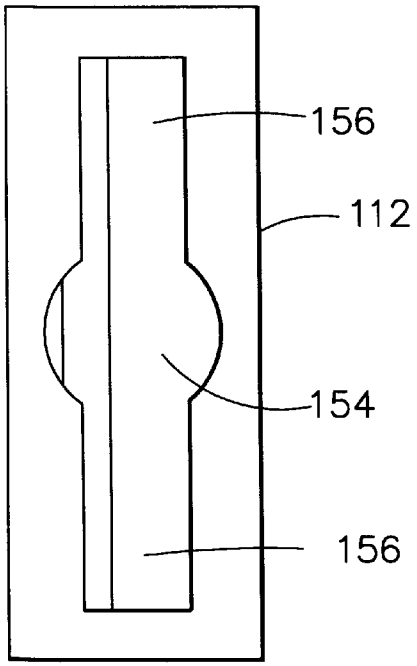
FIG. 8 is a view of the end face and trigger of a bolt for use in a swinging door installation.

Referring now to FIG. 8, a spring bolt assembly 112 similar to FIG. 5 is illustrated. The spring bolt assembly 112 is identical to the spring bolt assembly 12 in FIG. 5, with the exception of the trigger element 134. Trigger element 154 has a beveled or chamfered surface 156 in a direction permitting a camming engagement of the trigger 154 with a container member in a direction parallel to the plane of the drawing, and in all other regards the spring bolt assemblies 12 and 112 are identical.

Figure 9:
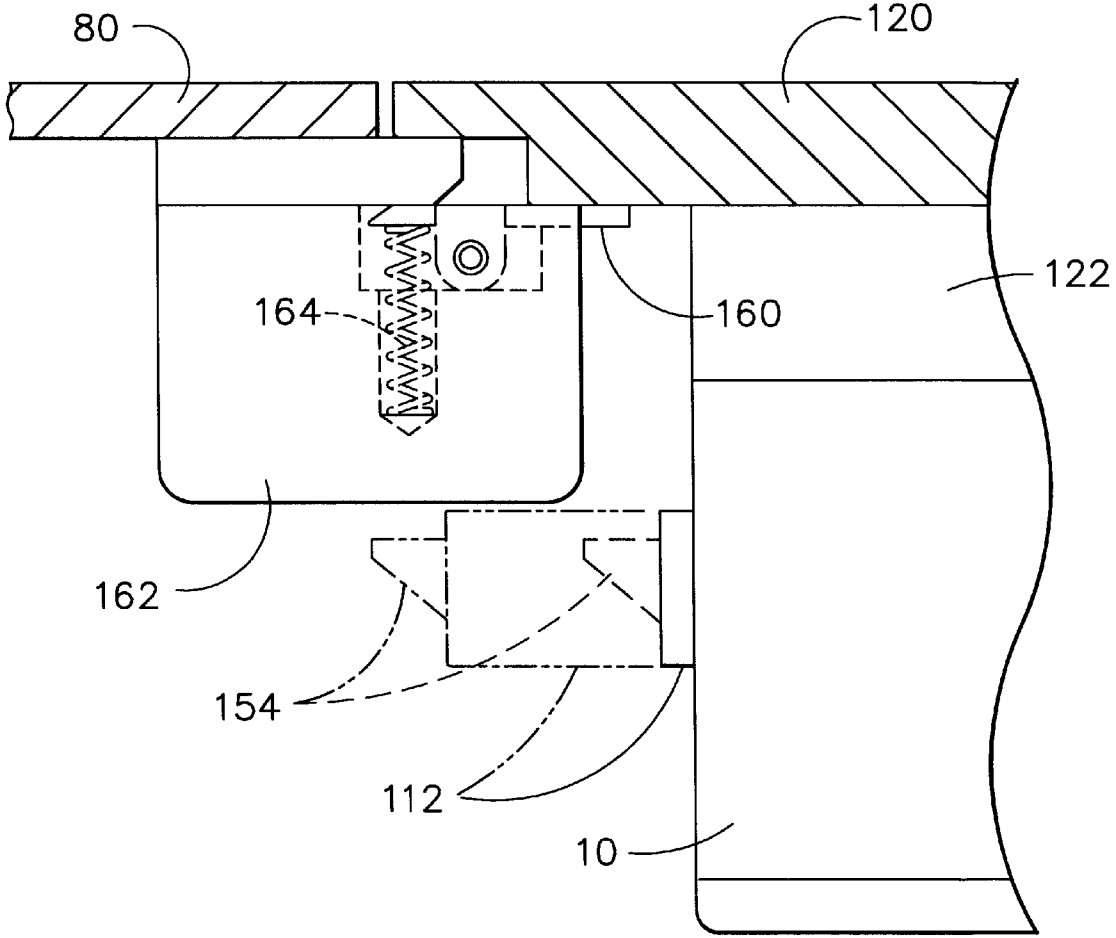
FIG. 9 is an illustration of a swinging door installation having a pivotable strike mounted on the container.

FIG. 9 illustrates an arrangement incorporating a pivotable strike 160 disposed within a container 80 so that the spring bolt assembly 112 can be moved outwardly past and away from the strike 160 upon opening the door 120 without triggering the extension of the outer bolt member 42. The configuration of trigger element 154 is such that swinging of a door 120 carrying the lock 10 and spring bolt assembly 112 past strike 160, i.e., conventionally swinging door 120 shut, will activate the trigger 154 and cause unlatching of the outer bolt 42 from the inner bolt 40 in the same manner as activation and unlatching of trigger 34 in FIGS. 1–4.

The strike 160 is pivotally mounted on frame 162. The strike 160 pivots against spring 164 and out of interference with the spring bolt assembly 112 upon opening of the container door 120, but will be resistive to displacement whenever the spring bolt assembly 112, particularly trigger 154 engages strike 160 in a closing directional movement. Strike 160 is spring-biased by spring 164 to assume a position blocking free movement of the spring bolt assembly 112 and particularly trigger 154 into the container 80. As spring bolt assembly 112 and particularly outer bolt 42 are extended for purposes of locking, the outer bolt 42 will extend behind rigid, non-moveable frame 162 supporting the strike 160, preventing the door 120 from being opened until the spring bolt assembly 112 is withdrawn sufficiently to disengage from the frame 162, and then pivot the strike 160 out of position, permitting the spring bolt assembly 112 to pass and the container 80 to be opened.

As seen in FIG. 9, it is typically necessary to space the lock 10 from the container door 120 to position the spring bolt assembly 112 behind the frame 162 in its extended position. Accordingly, a spacer or riser plate 122 is disposed between lock 10 and container door 120.

Figure 10:
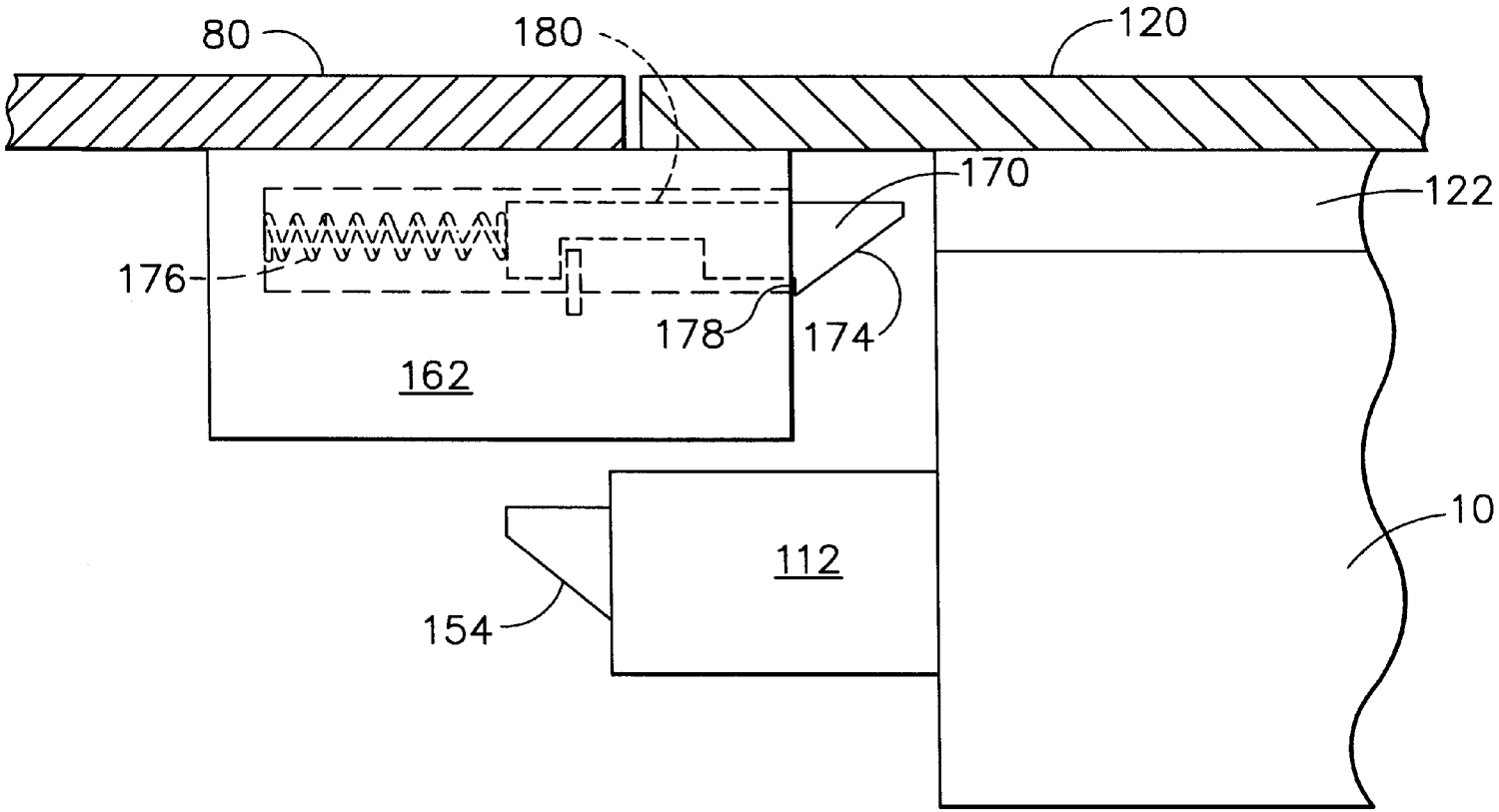
FIG. 10 illustrates the lock used with a spring biased plunger strike.

An alternative embodiment to the strike shown in FIG. 9 is shown in FIG. 10. The strike 170 is preferably a plunger 170 which is spring biased to an extended position projecting from the housing or frame 162. Strike 170 is fabricated with a beveled surface 174 on the projecting end with the bevel facing the interior of the container 80. The bevel 174 of strike 170 is engageable by the spring bolt assembly 112 or the trigger 154 and forced inwardly into the frame 162 against spring 176. Strike 170 is formed with an abutting surface 178 perpendicular to the axis of movement of the strike on the side of strike 170 disposed toward the interior of the container 80. Shaft portion 180 of strike 170 is narrower than the channel containing the strike 170, by at least the width of the abutting surface 178.

The operation of strike 170 is effected by and dictated by the direction of passage for spring bolt assembly 112. When the spring bolt assembly 112 is withdrawn into the lock 10 and the container's opening outward door 120 is opened, the spring bolt assembly 112 will engage the strike 170 and force the strike 170 upward in FIG. 10. The spring resistance exerted on strike 170 by spring 176 is insufficient to cause the displacement of trigger 154 to unlatch bolt assembly 112. This opening outward movement of lock 10 and therefore strike 170 will cause the abutment surface 178 to be raised to clear frame 162 and strike 170 will be cammed into a retracted position within frame 162 against spring 176. Strike 170 will extend once spring bolt assembly 112 is passed, under the influence of spring 176.

When the container door 120 is closed, the spring bolt assembly 112, in its withdrawn position will engage strike 170 and initially force strike 170 downward as in FIG. 10. This downward movement aligns abutment surface 178 with frame 162, preventing the retraction of strike 170 into frame 162. The strike 170 is then maintained extended against the force of the trigger 154 as it passes and thus forces trigger 154 to a retracted position within spring bolt assembly 112, unlatching the spring bolt assembly 112 for extension and locking the container as earlier described.

Figure 11:
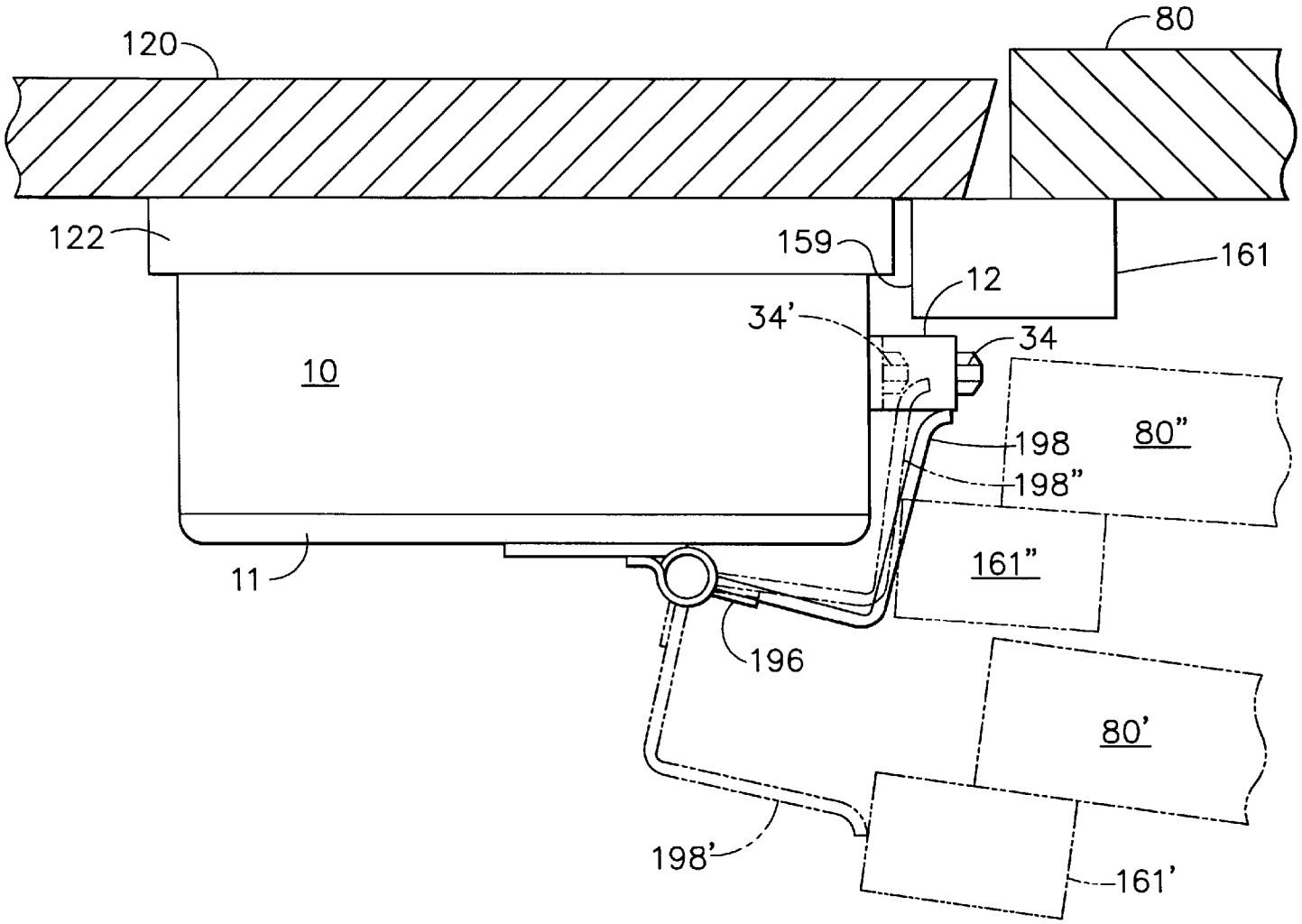
FIG. 11 illustrates the lock used with a solid strike and an actuator mounted on the lock.

A further, alternative embodiment of the container locking system, including a lock 10 and actuator 198 for locking container 80, is illustrated in FIG. 11. The container locking system is shown in three relative positions, with the container 80 closed and locked, opened and disengaging from the spring bolt actuator 198 and closing to actuate the spring bolt 34.

For case and clarity, the safe or container 80 is shown in various positions relative to the container door 120. The container door 120 is the moveable element of the container 80.

Referring to FIG. 11, the container 80 is closed by door or closure 120 shown as a fragment. A combination lock 10 is mounted on a riser plate 122 and door 120 of container 80 such that the spring bolt assembly 12, extends past the edge 159 of strike 161 to lock the container. In the position of the lock 10 as just described, the bolt actuator 198, hinged or pivotally mounted to the lock back cover 15 will ride on the spring bolt assembly 12, under the influence of a spring bias thereon by torsion spring 196.

Upon the operation of the lock 10 to withdraw the spring bolt assembly 12 to clear strike 161, the bolt actuator 198 will engage the trigger 34 and will be further engaged by the strike 161 as the container door 120 swings open. Upon engagement of the actuator 198 with the strike 161, and further container opening movement the actuator will be pivoted to a position indicated as 198' by the relative movement of the container door 120 and lock 10 past strike 161 and container 80.

Further opening of the container door 120 will permit disengagement of the actuator 198 from the strike 161 and allows the actuator 198 to again assume the position indicated as 198" relative to the trigger 34 of the spring bolt assembly 12.

The actuator 198 will remain in contact with and overlying trigger 34 as door 120 of container 80 is swinging closed. Upon closing movement of the door 120, the actuator will be interposed between the trigger 34' in its retracted position and the strike 161" and will be forced toward lock 10 by interference with strike 161. Movement toward the lock 10 will depress trigger 34" into the spring bolt assembly 12 unlatching the spring bolt assembly 12 for extension and locking when clear of strike 161, as described with respect to the spring bolt assembly 12 in FIGS. 1–7.

Accordingly, the actuator 198 may be pivoted out of engagement with spring bolt assembly 34 by strike 161, providing clearance for trigger 34 to freely pass strike 161, and upon closing the actuator, interposed will interfere with strike 161 and force trigger 34 to unlatch the spring bolt assembly for extension and locking.

One will appreciate that modifications and changes may be made to the disclosed invention without modifying it to the extent that it will be removed from the scope of protection afforded by the appended claims.

We claim:

1. A self locking dial combination lock comprising:

a bolt extending from a lock housing of said combination lock and having an extended, securing position and a withdrawn releasing position;

a bolt withdrawal mechanism responsive to a manually operated input for withdrawing said bolt from said extended position to said withdrawn position;

said bolt comprising:

a first member connected to and responsive to said bolt withdrawal mechanism for displacement relative to said lock;

a second member associated with and moveable with respect to said first member;

a latch interconnecting said first member and said second member for capturing one of said members relative to another of said members for movement of said members in a first direction as a unit and for releasing said members for movement in a second direction independently;

a latch operating mechanism for operating said latch for releasing said members, whereby said second member is released to extend to said extended securing position when said latch operating mechanism is displaced by engagement with a rigid interfering structure, while said first member remains in said withdrawn position.

2. The self locking dial combination lock of claim 1 wherein said latch operating mechanism comprises a displaceable member and a latch engaging portion operatively engageable with said latch for transmitting displacement of said displaceable member to said latch.

3. The self locking dial combination lock of claim 2 wherein said displaceable member protrudes from said second member.

4. The self locking dial combination lock of claim 3 wherein said displaceable member is resident within said second member.

5. The self locking dial combination lock of claim 1 wherein said latch operating mechanism comprises a displaceable member disposed for engagement by said interfering structure when said second member is resident in said withdrawn position.

6. A self locking dial combination lock comprising:

a bolt displaceable between a withdrawn and extended positions;

a bolt operating mechanism;

said bolt comprising a base member connected to and responsive to said bolt operating mechanism for withdrawal and extension and a resiliently biased extension member connectable to and displaceable with said base member;

a latch for connecting said base member and said extension member for movement as a unitary structure in a first direction and for releasing said base and extension members for movement independently in a second direction;

a latch control member for unlatching said latch, said latch control member exposed though one face of said bolt to an interfering structure exterior to said lock and engageable with said structure to effect unlatching of said latch and permitting extension of said extension member.

7. The self locking dial combination lock of claim 6 wherein said latch control member extends from said extension member.

8. The self locking dial combination lock of claim 7 wherein said extension member comprises an end face and said latch control member is exposed through said end face.

9. The self locking dial combination lock of claim 8 wherein said latch control member is displaceable into engagement with said interfering structure, said latch responsive to said latch control member being displaced by engagement with said interfering structure.

10. The self locking dial combination lock of claim 9 wherein said combination lock further comprises a detenting member engaged with said extension member and said extension member comprises a detenting member engagable recess alignable with said detenting member, said detenting member and said recess alignable when said extension member resides in an extended position.

11. The self locking dial combination lock of claim 10 wherein said detenting member and said detenting recess are so related that said detenting member extends sufficiently into said detenting recess to block movement of said extension member from said extended position when said base member is in said withdrawn position and said extension member is in said extended position.

12. The self locking dial combination lock of claim 11 wherein said base member comprises a portion engagable with said detenting member for displacing said detenting member from said detenting recess sufficiently to permit movement of said extension member.

13. The self locking dial combination lock of claim 12 wherein said portion of said base member is in engagement with said detenting member when said base member is resident in said extended position and said base member and said extension member are connected by said latch.

14. A self locking dial combination lock comprising:

a bolt extending from a lock housing and moveable between an extended, securing position and a withdrawn, releasing position;

a bolt withdrawal mechanism driven by and operative responsive to a manually rotated dial for withdrawing said bolt from said extended position to said withdrawn position;

said bolt comprising a base bolt and an extension bolt, said extension bolt displaceable relative to said base bolt;

a latch surface within said extension bolt;

a latch disposed within said base bolt and engagable with said latch surface of said extension bolt;

a releasing member carried by and moveable relative to said extension bolt engageable with said latch for removing said latch from engagement with said latch surface, whereby said movement of said releasing member unlatches said base bolt from said extension bolt permitting said extension bolt to move independently of said base bolt.

15. The self locking dial combination lock of claim 14 wherein said base bolt and said extension bolt are resiliently biased apart.

16. The self locking dial combination lock of claim 15 wherein said releasing member is disposed within and projecting from said extension bolt through an end face of said extension bolt.

17. The self locking dial combination lock of claim 16 wherein said releasing member comprises an external engagement surface engageable with a rigid member to displace said releasing member.

18. The self locking dial combination lock of claim 14 wherein said lock further comprises a dead locking mechanism to prevent movement of said extension bolt when said extension bolt is resident in said extended position and said base bolt is resident in said withdrawn position.

19. The self locking dial combination lock of claim 18 wherein said dead locking mechanism comprises a detenting member projectable into said extension bolt to an extent preventing movement of said extension bolt from said extended position when said base bolt is other than in said extended position.

20. The self locking dial combination lock of claim 19 wherein said extension bolt comprises a recess sufficiently deep to accommodate said detenting member to an extent that said detenting member may not be displaced from said recess by exertion of force on an end face of said extension bolt.

21. The self locking dial combination lock of claim 20 wherein said detenting member is a ball and said recess is dimensioned in depth to accept therein more than one one-half the diameter of the ball, whereby said ball blocks movement of said extension bolt.

22. The self locking dial combination lock of claim 21 wherein said base bolt comprises a surface disposed to engage and displace said ball from said recess to at least the extent wherein less than one half of said diameter of said ball resides within said recess, upon extension of said base bolt to said extended position.

* * * * *